United States Patent [19]

Schmidt

[11] 4,346,527

[45] Aug. 31, 1982

[54] SNOW REMOVAL APPARATUS

[75] Inventor: Alfred Schmidt, St. Blasien, Fed. Rep. of Germany

[73] Assignee: Alfred Schmidt, GmbH, St. Blasien, Fed. Rep. of Germany

[21] Appl. No.: 237,993

[22] Filed: Feb. 25, 1981

[30] Foreign Application Priority Data

Jul. 18, 1980 [EP] European Pat. Off. ..... 80104230

[51] Int. Cl.[3] ..... E01H 5/00

[52] U.S. Cl. ..... 37/250; 37/251

[58] Field of Search ..... 37/43 R, 43 K, 23, 26, 37/27, 43 C, 53

[56] References Cited

U.S. PATENT DOCUMENTS

| | | | |
|---|---|---|---|
| 1,641,723 | 9/1927 | Zinn | 37/43 C |
| 1,671,358 | 5/1928 | Fahrney | 37/43 K |
| 3,618,748 | 3/1970 | Burkett | 37/43 K |
| 4,151,663 | 5/1979 | Schmidt | 37/43 K |

*Primary Examiner*—E. H. Eickholt

[57] ABSTRACT

Snow removal apparatus has a housing open at its front end in which a central fan blower is mounted. Mounted to the housing forwardly of and flanking the central fan are a pair of vertically rotating clearing screws. Each of the screws is also provided with a deflector which is movable in a circular path concentric with the axis of rotation so as to provide a selectively positionable backing or rear wall therefor.

9 Claims, 4 Drawing Figures

SNOW REMOVAL APPARATUS

BACKGROUND OF THE INVENTION

The present invention relates to snow removal equipment and, in particular, to equipment adapted for attachment to vehicles.

A snow blower is shown in applicant's prior U.S. Pat. No. 4,151,663, dated May 1, 1979, which is capable of being attached to the front of the transport vehicle such as the front end of a railroad engine. A snow thrower in the form of a fan type blower is flanked on each of its lateral sides by a clearing screw in the form of a helical worm which rotates about a vertical axis. Each of the clearing screws is provided with a deflector which extends along the entire length of the screw. The deflector is hinged along one edge by a piano hinge or the like and is swingable about the axis of this hinge by a hydraulic motor from a position adjacent the generatrix of the clearing screw to a position spaced at an angular relationship thereto. In this manner, the deflector can be swung like a door or flap so as to be positioned selectively with respect to the surface associated clearing screw to guide snow collected along the outer edges of the clearing screw into the clearing screw itself and from thence, onto the fan. To permit use of the apparatus in solidly frozen snow, the deflector is swung to the rearmost position where it remains inactive and not subject to damage by the frozen snow. Nevertheless, practical experience has shown that such a deflector, as is described in the aforementioned patent, while very useful, can be easily damaged, particularly when swung into its inactive position.

Accordingly, it is an object of the present invention to improve the design of the snow removal equipment of this type so as to provide deflectors which have greater strength and stability.

It is another object of the present invention to improve the design of the deflector in order to facilitate their more selective adjustability and to enable their effectiveness in a greater number of selected positions.

The foregoing objects, as well as other objects and advantages will be clearly apparent from the following disclosure of the present invention.

SUMMARY OF THE INVENTION

According to the present invention, snow removal apparatus is provided, having a housing open at its front end in which a central fan blower is mounted. Mounted to the housing forwardly of and flanking the central fan are a pair of vertically rotating clearing screws. Each of the screws is also provided with a deflector comprising an arcuate located generally to the rear thereof, which is mounted so as to be movable in a circular path concentric with the axis of rotation of the clearing screw, and independently of the clearing screw and of each other.

Each deflector is arranged so as to be contiguous with or only slightly spaced from the peripheral surface or generatrix of the associated screw and to be movable in a circular path wherein the leading edge can swing in an arc of about 50 to 100 degrees from a position about 40 to 45 degrees forward of the plane in which the axis rotation to the clearing screws are located to a position rearwardly of the plane.

As distinguished from the prior art, the deflector of the present invention is never lifted from the surface of the clearing screw no matter what position it is placed in. However, the operator can adjust the position of the deflector so that the leading edge is in exactly the position required for particular snow conditions. In the case of powdery snow, soft snow or wet snow, the operator can select a position where the leading edge of the plate is in front of or, at least at the center of the plane in which the axes of rotation are located. For hard snow, the operator may move the deflector plate to its rearmost position thus being placed out of danger from damage from the hard snow. In this manner, the deflector may be selectively positioned whereby it will always be most effective in collecting and moving the snow into the clearing screw and into the fan. In this connection, it would be obvious that the effective cross-section for snow removal of the entire unit is thereby increased.

Due to the partially cylindrical form of the deflector, the deflector has a high degree of stability and strength permitting it to be used in the customary kinds of snow, to cut the snow wall without suffering any damage.

It is preferable, that the deflector plate be made in the form of a cylindrical section having an arc extending roughly over an angle of 70 to 100 degrees, but more preferably, about 75 to 84 degrees of angle. The range of circular movement, for all customary removal tasks, may encompass only a path angle of 60 to 65 degrees. The cylindrical section forming the deflector is formed with corresponding top and bottom end members which are journalled about the shaft of the associated clearing screw to thus be easily movable, concentric thereabout.

It is also desirable to provide a cylindrical jacket fixed to the housing, behind the deflection plate so as to tightly, but in sliding engagement, envelop the exterior surface of the deflector. In this manner, the rear portion of the deflector is supported by the jacket enabling the unit to be used in very heavy or icy snow conditions.

It is furthermore expedient to arrange the drives for the clearing screws, and the drive for moving the deflectors both on an upper supporting arm in which the respective clearing screw is mounted. Both drives are preferably in the form of hydraulic rotary motors, although electric motors or the like may also be used.

The use of hydraulic system makes it possible to operate the drives from the hydraulic system already existing in vehicles of the type to which the apparatus is to be appended.

The drive means for the deflector is preferably connected to the deflector by means which simultaneously lock the deflector immovably in its given position.

Further details of the present invention are set forth in the following description of its preferred embodiment, and are shown in the accompanying drawings.

DESCRIPTION OF THE PREFERRED EMBODIMENTS

As seen in the figures, the snow removal unit consists essentially of a central snow blower, generally depicted by the numeral 1 and a pair of lateral clearing screws 2 and 3 mounted forwardly and slightly to the side of the snow blower so as to flank it. The blower 1 comprises a fan arranged within a covering housing 5. The housing 5 forms a conventional side and back hood, open at its forward end and is provided with an ejection stack or chimney chute as well as the usual means for attachment to the vehicle such as the head end or car of a train.

Figure 2:
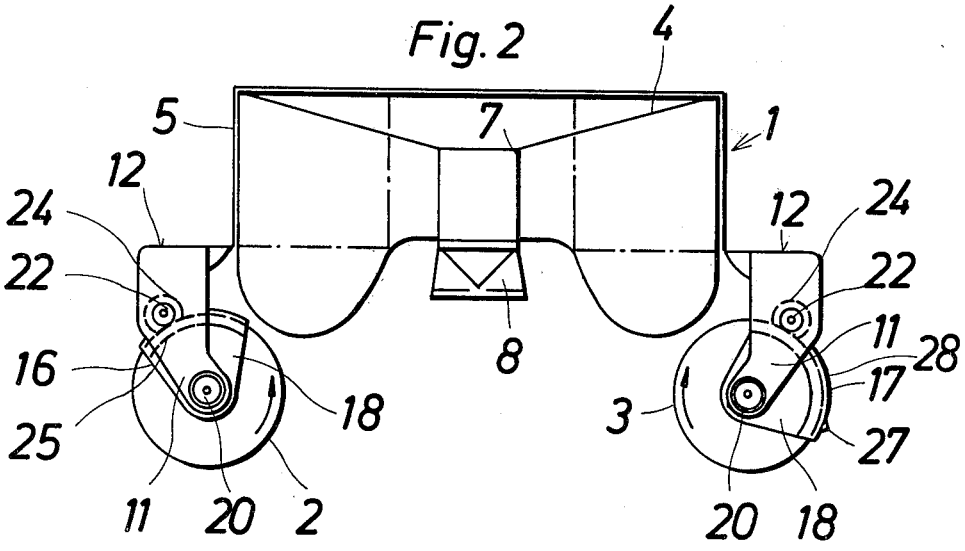
FIG. 2 is a top plan view of the unit shown in FIG. 1.

The fan has four curved blades 6 secured at their root to a hub 7 rotatable about a fixed horizontal axis for added strength welded to the front edges of the blades. The hub has at its forward end, or clearing side, a pre cutter, generally depicted by the numeral 8 formed of two linear knives 9 and 10. The hub 7 houses the fan shaft which extends through the back wall of the housing and is connected to drive means such as a motor or gear transmission connected to a motor as is well known. The fan blades rotate in a vertical plane generally perpendicular to the horizontal axis of the hub. The clearing screws 2 and 3 are journalled in forwardly extending brackets 11 formed with or mounted on opposed top and bottom bezels 12 and 13 extending from the housing 5. The clearing screws 2 and 3 comprises a helical screw member 14 secured by its root to a central shaft 15, and rotate about the axis of shaft 15 in opposite directions (indicated by the arrows of FIG. 2) so as to move the snow from the lateral side of the unit, inwardly toward the fan wheel 6.

The clearing scres 2 and 3 are, in part, covered by a deflector generally indicated by the numeral 16 and 17, respectively. Each of the deflectors are in the form of a cylindrical section 28, of between 70 to 100 degrees arc and comprise an elongated brace 27 secured on the outer surface of the comparably elongated plate 28, along its leading edge 29. The plate 28 is provided with top and bottom end members 18 and 19 which are wedge-shaped, and have a radious only slightly greater than that of the clearing screw.

The cylindrical sectioned deflectors are journalled at the cylindric centers of the top and bottom end members between the support brackets 11 and the bezel rails 12 and 13, respectively, so as to rotate concentrically about the axis of rotation of the clearing screw while being substantially contiguous to the peripheral edge or generatrix of the screw.

The bezel rail 12 supports two jackets 31 which extend arcuately about the clearing screws 2 and 3, respectively, forming therefor a back wall. The jacket 31 is also elongated and arcuate in cross-section in a radius conforming to that of the clearing screw and is spaced from the clearing screw sufficient only to permit the deflectors 16 and 17 to move between the two. The leading edge 30 of the jacket 31 forms a rear abutment stop for the brace 27 of the deflector. The jacket 31 is also provided with horizontal stiffening ribs 38.

Mounted on the upper support bracket 11, in association with each of the clearing screws 2 and 3, are two hydraulic motors 20 and 22, respectively. The motor 20 drives a planetary gear train 21 connected to the shaft 15 of the associated clearing screw and functions to rotate the clearing screw in the direction indicated. The motor 22 is provided with a pinion 24 secured to its output shaft which pinion meshes with a chain 25 secured in a U-shaped bar 26 which is, itself, welded or secured in an arcuate path of at least 60 to 65 degrees and preferably 50 to 100 degrees, on the top end 18 of the deflection plate. Operation of the motor 22, thus enables the selective swiveling of the deflectors about the axis of the shaft 15, the pinion and chain provided a positive locking and placement arrangement, in combination with the motor, which once the motor is stopped, maintains the deflection plate in its given position. A rack or other gear type drive means may be similarly used.

The deflectors 16 and 17 are thus selectively swivelable in a circular path by operation of the motor 22, from a rear position which the base 27 abuts the stop edge 30 of the jacket to a forward position defined by the extent of the chain 25. Preferably, the forward most point in which the leading edge of the deflector plate may be placed is about 55 degrees ahead of the plane in which the shaft 15 of both screws lie as will be seen in FIG. 2.

Figure 1:
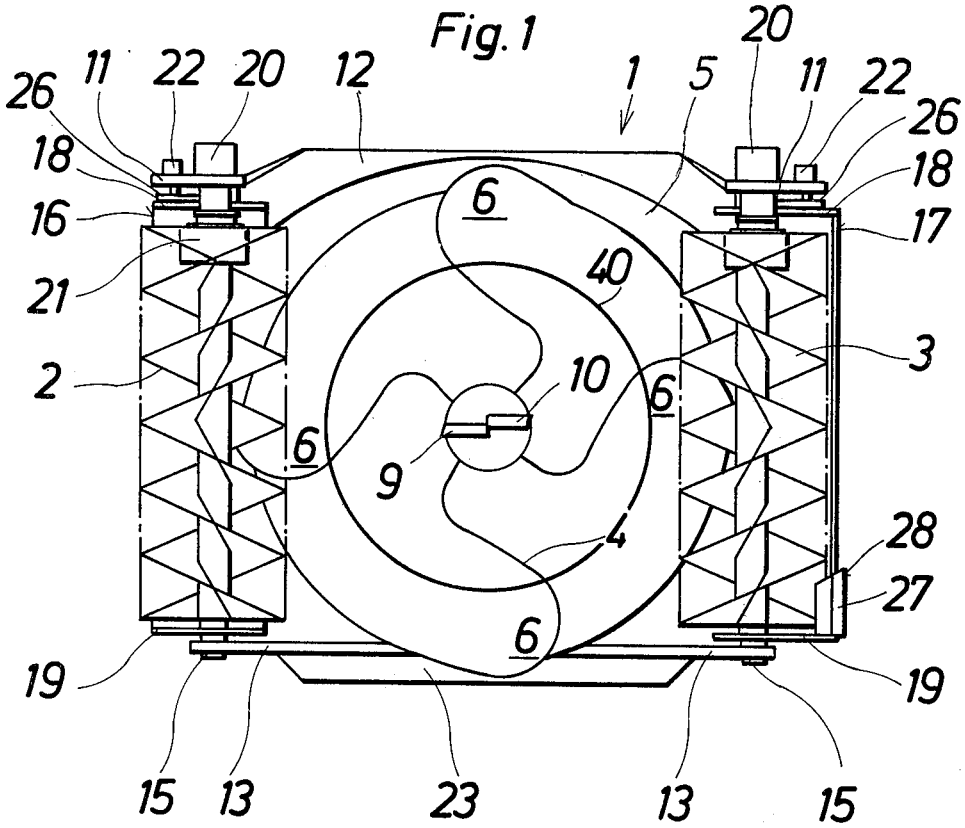
FIG. 1 is a front elevational view of a snow removal unit embodying the principles of the present invention.
Figure 4:
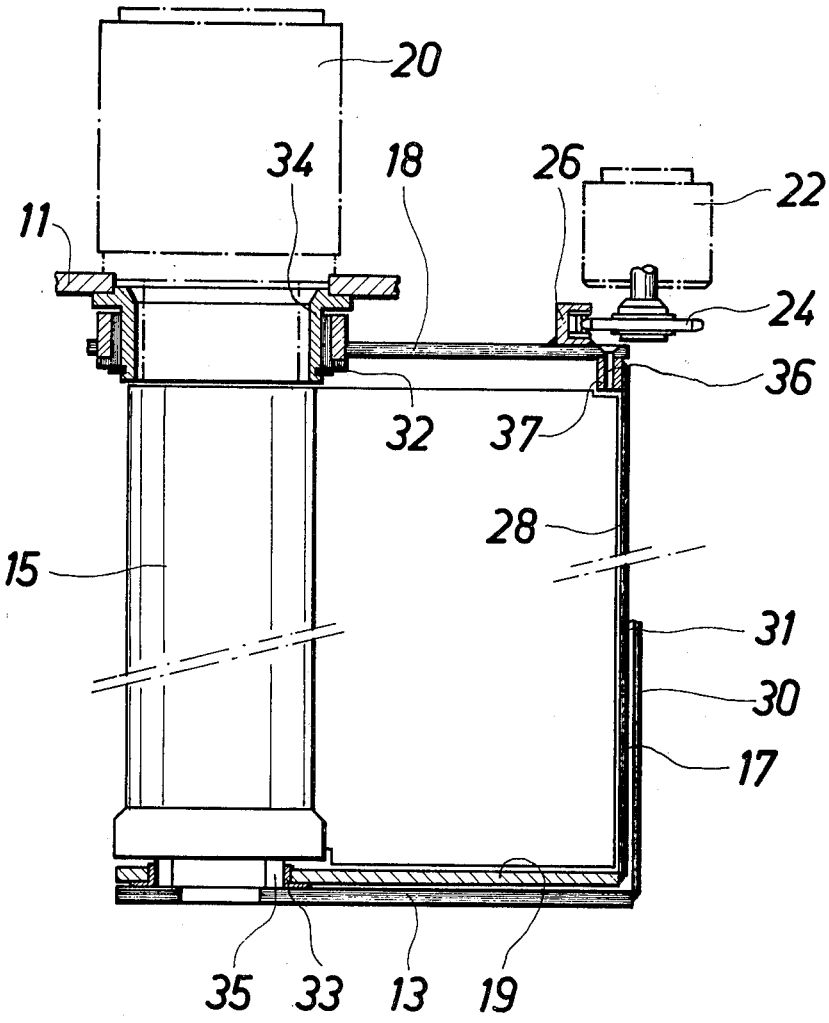

In the half section shown in FIG. 4, the deflector 17 is foreshortened in the direction of the axis of rotation. The cylindrical section of the plate 28 with its wedge-shaped top and bottom members 18 and 19, respectively, are clearly shown. These parts enable the deflector to be resistent to deformation or damage. The top end member and the bottom end member are provided with bearing openings so that they can be placed over the shaft 15. Both end members are supported in the area of their bearing by radial and axial low friction bearing bushings 32, 33, which engage bearing rings 34 and 35 mounted directly on the shaft 15. The slide bushing 33, of the bottom end member 19, is furthermore seated axially on the lower bezel rail 13 which is, in turn, firmly connected to the attached housing. A further structurally supporting rail 23, seen in FIG. 1, is employed to strengthen the rail 13.

Figure 3:
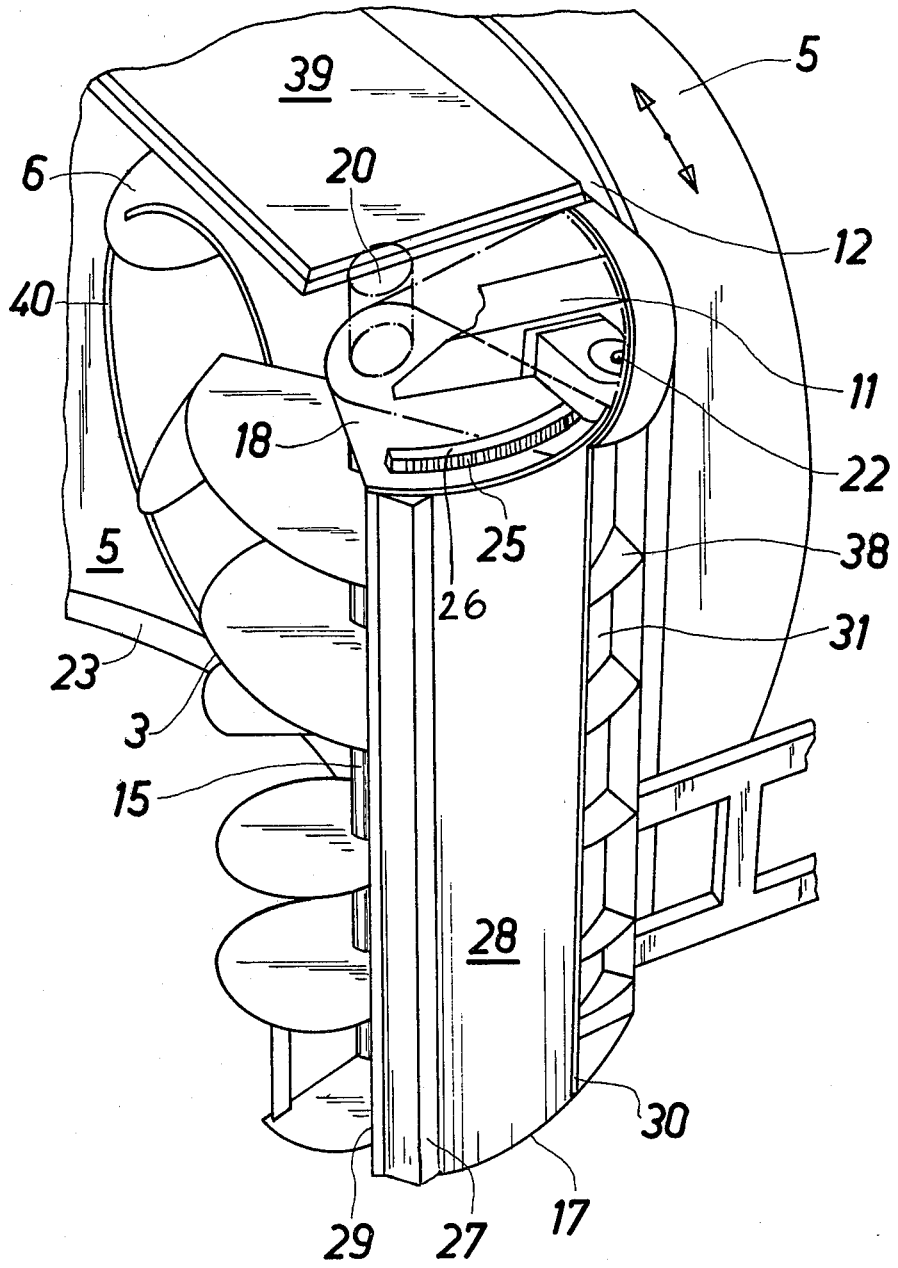
FIG. 3 is an enlarged perspective view showing the clearing screw and the deflector plate and, FIG. 4 is a vertical section through the axis of rotation of the clearing screw.

To permit easy assembly of the deflector on to the shaft 15, the end member 18 is formed separately from the arcuate plate 28 and is bolted thereto by means of screws 36 set in an arcuate boss 37 which is welded onto the plate 28. To prevent snow from blowing upwardly into the path of the operator, a cover 39 is installed above the level of the fan as seen in FIG. 3.

While the foregoing has described the preferred embodiment of the invention, various modifications and changes have also been suggested. Other modifications and changes will be obvious to those skilled in the art and, therefore, it is intended that the present disclosure not be taken as limiting of the scope of the present invention.

What is claimed is:

1. Apparatus for the removal of snow comprising a housing adapted to be attached to a vehicle, a blower mounted within said housing, a pair of vertically rotating clearing screws attached to said housing forwardly of and flanking said blower, and an arcuate deflector plate associated with each clearing screw, each of said deflector plates being mounted so as to lie adjacent the peripheral edge or generatrix of the associated clearing screw and being movable in a circular path, coaxial to the axis of rotation of the associated screw from a position forwardly of the plane in which the axes of rotation of each of said screws lie to a position to the rear thereof.

2. The apparatus, according to claim 1, wherein said deflector plate comprises a cylindric section plate having a top end and bottom end member, said end members being journalled about the shaft of said clearing screws, said cylindrical section plate having a cross-sectional arc of between 70 and 100 degrees.

3. The apparatus, according to claim 1, wherein said circular path extends over an arc of between 50 to 80 degrees.

4. The apparatus, according to claim 1, wherein the position of said deflector forwardly of the plane of the axes of rotation does not exceed 55°.

5. The apparatus, according to claim 1, wherein said clearing screws are journalled between a pair of brackets extending forwardly of and fixedly mounted to said housing.

6. The apparatus, according to claim 5, wherein said deflector comprises a cylindric section shell having an elongated arcuate plate with a pair of end members, the end members being journalled about the axis of rotation of said associated clearing screws.

7. The apparatus, according to claim 6, including motor means for moving said deflector, said motor means being mounted on said forwardly extending bracket and being provided with transmission means connected to said deflector.

8. The apparatus, according to claim 7, wherein said transmission means compress a pinion secured to the shaft of said motor means and a chain fixedly secured to the top end member of said associated deflector meshing therewith.

9. The apparatus, according to claim 6, 7 or 8, including motor means for rotating said clearing scres, said motor means being mounted on said forwardly extending bracket and including gear means connecting said motor means to the shaft of said clearing screw.

* * * * *